United States Patent [19]

Keck

[11] Patent Number: 4,558,804

[45] Date of Patent: Dec. 17, 1985

[54] FOOD CONSUMPTION APPLIANCE

[76] Inventor: Terry W. Keck, 306 Cherry Hill Rd., Kalamazoo, Mich. 49007

[21] Appl. No.: 524,838

[22] Filed: Aug. 19, 1983

[51] Int. Cl.[4] ..... B67D 5/64

[52] U.S. Cl. ..... 222/130; 222/144; 222/168.5

[58] Field of Search ..... 222/129, 129.1, 129.3, 222/130, 132, 133, 144, 144.5, 168.5, 168, 170; 119/51.13, 51.5, 52 B, 56 A; 221/96; 211/77, 78

[56] References Cited

U.S. PATENT DOCUMENTS

| | | | |
|---|---|---|---|
| 469,364 | 2/1892 | Hull | 222/144 |
| 1,400,145 | 12/1921 | Duncan | 211/77 |
| 1,438,173 | 12/1922 | Feindt . | |
| 1,551,119 | 8/1925 | Radek . | |
| 2,141,337 | 12/1938 | Bailey . | |
| 3,302,831 | 2/1967 | Matheney | 222/132 |
| 3,900,007 | 8/1975 | Smith | 119/51.13 |
| 4,000,719 | 1/1977 | Richards | 119/51.13 |
| 4,069,940 | 1/1978 | Naimoli . | |

FOREIGN PATENT DOCUMENTS

| | | | |
|---|---|---|---|
| 221005 | 9/1924 | United Kingdom | 119/56 |

*Primary Examiner*—H. Grant Skaggs

*Attorney, Agent, or Firm*—Varnum, Riddering, Schmidt & Howlett

[57] ABSTRACT

A food consumption appliance (100) for use in consuming dry comestibles such as ready-to-eat cereals in combination with liquids comprises a stabilized lower fluid compartment (102) for holding milk and other liquids. The lower compartment (102) includes a straw hole (114) positioned through a lateral surface of a cylindrical portion (108) of the compartment (102), and the compartment (102) threadably receives an upper compartment (120) having a downwardly-angled food consumption spout (132). The upper compartment (120) rotatably supports a carousel (140) having radially projecting spoon sections (150) for holding dry comestibles to be consumed by the user. As the carousel (140) is manually rotated, the spoon sections (150) sequentially pass over and align with the spout (132) and the comestibles are dispensed therethrough. The user can selectively consume the comestibles and extract liquid through the straw hole (114) as desired.

16 Claims, 5 Drawing Figures

FOOD CONSUMPTION APPLIANCE

TECHNICAL FIELD The invention relates to food appliances and consumption utensils, and more particularly, relates to manually-operable food consumption appliances for consuming dry comestibles and liquids.

BACKGROUND ART

It has long been known that various types of comestibles have a relatively more pleasant taste when mixed or otherwise consumed with liquids. Many types of foods fall within this category. Indeed, certain foods, such as many ready-to-eat dry cereals, are specifically manufactured with the intent that the cereals are to be mixed with liquids, such as milk, prior to consumption. To most individuals, these foods become relatively more palatable when a certain amount of liquid is absorbed by the dry foodstuffs.

However, the process of combining liquids with dry comestibles can produce difficulties. Specifically, the palatability of such combined foods is critically dependent on the level of liquid absorption by the dry comestibles. That is, many comestibles, such as ready-to-eat dry cereals, are not particularly palatable to a majority of the general public when consumed without any liquids whatsoever. Correspondingly, if such comestibles absorb too large an amount of liquids, the comestibles acquire an unpleasant taste, well-known to anyone who has let stand a mixture of dry cereal and milk for a substantial period of time. This resultant "soggy" taste is a principal reason that many individuals, both children and adults, avoid ready-to-eat dry cereals. Such avoidance is unfortunate, since many dry cereals are considered substantially more nutritious and generally healthful relative to various other comestibles which are often associated with and consumed during the breakfast meal.

It is obvious that one could advantageously consume mixtures of dry comestibles and liquids when such mixtures were in a state of "optimum palatability" if consumption could occur at a precise and known instant of time. However, different types of dry comestibles absorb liquids at differing rates. Accordingly, an optimum absorption level is attained at different times for different comestibles. Furthermore, the tastes of individual consumers vary dramatically. Thus, it would be substantially impossible for a food manufacturer to designate the level of liquid absorption that would provide the most palatable taste to all consumers.

In addition, and perhaps most importantly, the amount of food which an individual desires to consume at any one sitting is typically greater than one "mouthful" or "spoonful." Accordingly, comestibles such as dry cereals are usually poured into a bowl or similar holding container, and the consumer extracts portions of the cereals through the use of a spoon or other type of eating utensil. Liquids are typically poured into the bowl over the cereal prior to consumption. However, since all of the cereal cannot be consumed instantaneously, the liquid absorption level will differ for each mouthful. That is, the absorption level will be larger for those cereal mouthfuls which are consumed at relatively later times. While the first mouthfuls may be palatable, successively consumed subsequent mouthfuls become progressively bland and less palatable. Indeed, the last few mouthfuls are often negatively characterized (especially by children) as "mush."

In addition to the foregoing problems, consumption of dry comestibles and liquid mixtures in the manner previously described can lead to other problems. For example, when milk is poured over dry cereal in a bowl and consumed by a user, a cereal and milk residue typically remains in the bowl after consumption, the residue being too mushy or otherwise "gritty" and discolored to desirably consume. This residue results in waste of both cereal and milk, the expense of such waste being clearly apparent to today's consumer.

To overcome the foregoing problems, some individuals consume dry cereal and milk combinations by placing only a small amount of cereal in a bowl, pouring a small portion of milk over the cereal, consuming the same and then repeating the process throughout the duration of a meal. Such a process is both tedious and time-consuming. Indeed, training children to consume a meal in such a manner is typically difficult, if not altogether impossible.

Alternatively, a consumer can merely manually extract cereal from the box or bag in which it is commercially packaged, place the cereal in his/her mouth, and then consume liquid from a separate container or glass. However, such a process can also be tedious, in addition to being somewhat messy and unsanitary.

Finally, with respect to children, it is advantageous if mealtime can be an enjoyable and creative event, while remaining both sanitary and convenient. Advertisers and package designers for many foods directed toward youth have long been aware of these concepts. Unfortunately, as many parents are aware, convincing a child to consume nutritious foods, such as many of the commercially available cereals, is often a difficult task. Any uniqueness and creativity in the mealtime process can advantageously assist in the parents' goals with respect to healthful diet for their children.

The concept of avoiding the problem of ready-to-eat dry cereal becoming soggy during consumption is addressed to Naimoli in the U.S. Pat. No. 4,069,940, issued Jan. 24, 1978. The Naimoli patent describes a "crispy mix bowl" for dispensing comestibles such as dry cereal with milk. The device includes a lower frustrum-shaped bowl substantially open at the upper end thereof and adapted to receive comestible liquid, such as milk. Secured in a semi-circular fasion to a portion of the upper rim of the lower compartment is an upper compartment having a semi-circular configuration. One side of the upper compartment includes a hinged cover. Positioned approximately in the center of the upper compartment is a vertically-disposed pivotable sweeper. The dry cereal can be received in the upper compartment and the user can employ the sweeper to move the cereal toward a slot formed by an opening in the hinged cover. Accordingly, the cereal can be dispensed into the lower compartment containing the liquid at a rate corresponding to the user's consumption of the cereal and milk.

Although the Naimoli device is directed specifically to avoiding cereals becoming soggy during consumption, the cereal and milk are mixed within the device itself. The device does not provide any particular means for gauging the amount of cereal to be swept into the lower compartment. Accordingly, it would be somewhat difficult to provide only a mouthful of cereal within the lower compartment. Correspondingly, a preferred amount of condiments, such as sweetener and/or fruits, could not be gauged efficiently for each mouthful. Furthermore, the lower compartment contains an amount of milk necessary to consume the entire cereal meal. If only a small portion of the cereal is swept into the lower compartment at any one time, it may be somewhat difficult for the user to extract the cereal from the lower compartment, since the cereal will tend to disperse throughout all of the liquid milk. Should too much cereal be swept into the lower compartment, the problem of subsequently consumed mouthfuls becoming soggy will remain.

It is known to dispense food materials by means of manually rotatable devices. For example, to Radek the U.S. Pat. No. 1,551,119, issued Aug. 25, 1925, describes a dispensing device for sugar or other granular materials. The Radek device is in the form of a cylindrical case having a wheel-shaped structure formed therein with the spokes of the wheel being blades radially extending from a hub portion. The blades form a number of chambers for holding the granular materials. The periphery of the casing of the dispensing device includes an open spout adapted to communicate with consecutive chambers of the device as the wheel-like structure is manually rotated. The spout is configured so as to depend downwardly at an angle whereby gravity will cause materials to slide outwardly from the spout. Accordingly, as the blades are manually rotated, the granular material within chambers formed between the blades is selectively dispensed through the spout.

DISCLOSURE OF THE INVENTION

In accordance with the invention, a food consumption appliance is adapted for use by a consumer to consume a dry comestible and liquid in a manner so that the dry comestible can be maintained in a substantially dry state separate from the liquid until actual consumption, thereby avoiding "sogginess" which can occur if the comestible and liquid are mixed for too long a period of time prior to consumption. The consumption appliance includes liquid storage means for storing the liquid separate from the comestible. Liquid extraction means are adapted to be received in the liquid storage means to extract liquid as desired by the consumer. Comestible storage means are rotatably mounted above the liquid storage means and hold portions of the comestible prior to consumption. Spout means communicate with the comestible storage means and provide a slideway for portions of the dry comestible when the comestible storage means is manually rotated by a consumer so as to sequentially dispense portions of the comestible into the spout means.

The liquid extraction means is positioned adjacent the spout means to conveniently allow the user to extract portions of the liquid subsequently in time to reception by the consumer of portions of the dry comestible. In addition, the consumption appliance includes upper compartment means removably secured at a lower section to the liquid storage means. The spout means is attached to the upper compartment means and the upper compartment means provides for rotatable mounting of the comestible storage means.

The consumption appliance further includes stabilizing means mounted to a lower section of the liquid storage means so as to stabilize the appliance when it is positioned on a planar surface. The liquid storage means includes a vertically-disposed cylindrical portion and the stabilizing means can include an annular-shaped ring adapted to be received around the cylindrical portion. The ring includes rounded surfaces so as to avoid hazardous pointed edges or the like.

In accordance with one aspect of the invention, the liquid storage means includes a horizontally-disposed base and a vertically-disposed portion extending upwardly from the base so as to form an open-topped container. The extraction means can include a straw hole located in an upper section of the cylindrical portion and adapted to receive a straw or similar device to allow the user to extract liquid from the container. In addition, the liquid storage means includes an internally threaded collar which is integral with an upper portion of the cylindrical portion.

The upper compartment means comprises a corresponding externally threaded lower section which is adapted to be threadably received within the upper collar. In addition, the upper compartment means includes a frustrum-shaped portion which is downwardly tapered and connected at a lower end to the externally threaded lower section. An upper horizontally-disposed platform is connected to the upper end of the frustrum-shaped portion. A concave indentation is centrally located in the platform so as to rotatably support the comestible storage means in a stabilized manner.

The spout means can include an angled ramp surface which extends downwardly from the platform through a slot formed in an outer section of the frustrum-shaped portion. Parallel side walls extend upwardly from lateral edges of the ramp surface. The side walls can include rounded outer edges so that the spout means can be safely partially received within the mouth of the consumer.

The comestible storage means includes a central hub which is rotatably mounted to the upper compartment means. Compartmentalized sections extend radially from the central hub and are adapted to receive portions of the dry comestible. In addition, a convex portion extends downwardly from the central hub and conforms to the concave indentation of the platform so as to rotatably mount the comestible storage means to the upper compartment means.

In addition, a turning knob can be mounted to the upper portion of the central hub. Furthermore, the central hub can include a downwardly and outwardly slanted frustrum-shaped surface so as to assist in dispensing the dry comestible into the compartmentalized sections.

In accordance with other aspects of the invention, the upper compartment means can include a cylindrically-shaped side wall which extends upwardly from the platform and substantially conforms to the perimeter formed by the outer edges of the compartmentalized sections. In addition, the consumption appliance can include a supporting rim connected to the outer portion of each of the compartmentalized sections. A cover having an annular configuration can be placed over the compartmentalized sections, around the central hub, and attached to the cylindrically shaped side wall of the upper compartment means to prevent spillage of the dry comestible. Still further, the consumption appliance can also include handle means which are coupled to the liquid storage means so as to allow the consumer to manually grip the consumption appliance.

BRIEF DESCRIPTION OF THE DRAWINGS

An exemplary embodiment of the invention will now be described with respect to the drawings in which.

BEST MODE FOR CARRYING OUT THE INVENTION

Figure 1:
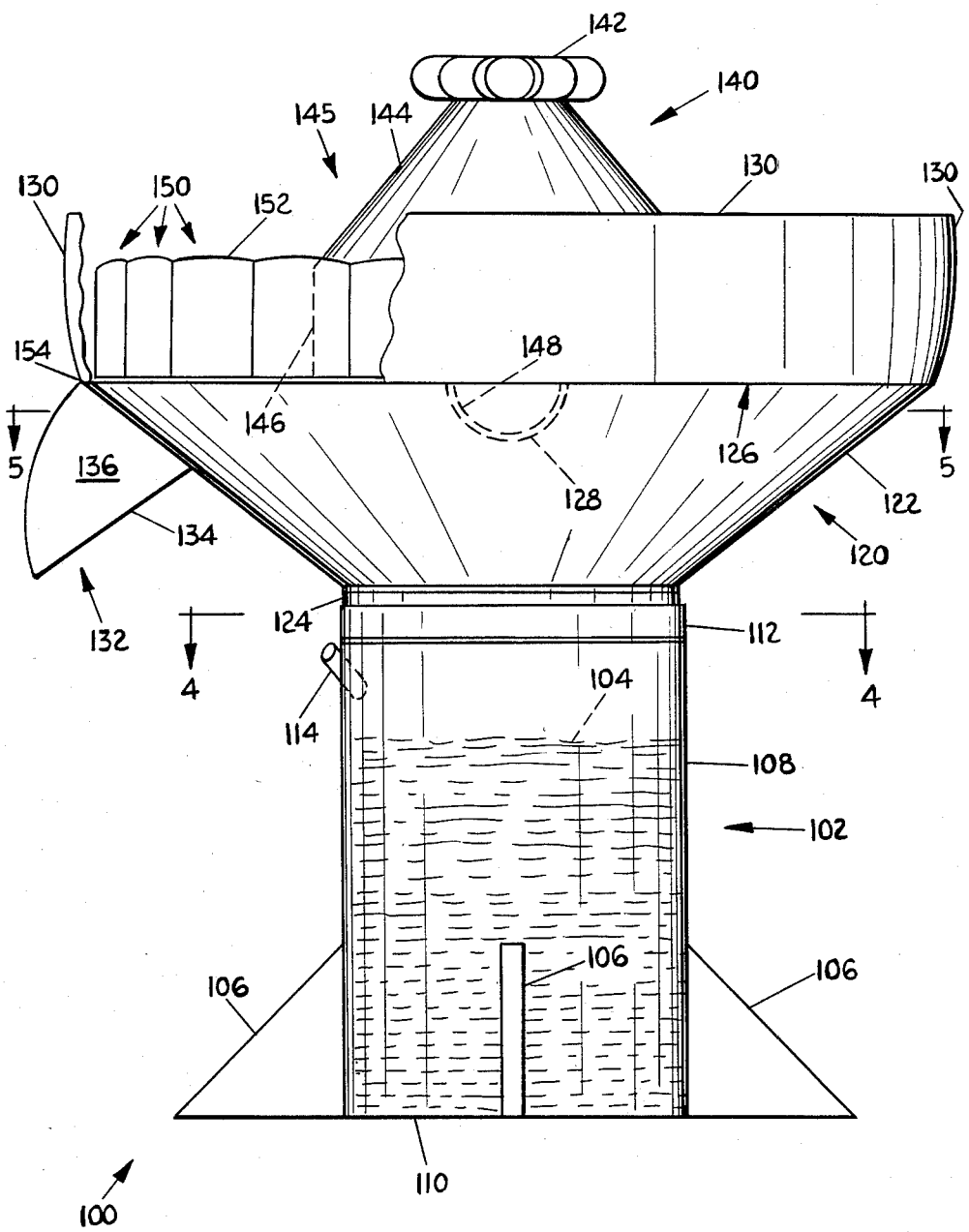
FIG. 1 is an elevational view of a food consumption appliance in accordance with the invention.

The principles of the invention are disclosed, by way of example, in a food consumption appliance 100 as depicted in FIG. 1. The consumption appliance 100 is adapted for use with dry comestibles, such as ready-to-eat cereals, which typically are relatively more palatable to the consumer when mixed with liquid, such as milk. The appliance 100 provides a manually operable means for the consumer user to selectively obtain mouthfuls of the dry comestible and then efficiently extract liquid from a convenient container as desired. Consumption of foods in this manner allows the user to mix the dry comestible and liquid within his/her mouth, select the relative volume of comestible to be consumed in one mouthful and to further select the relative volume of liquid to be consumed with the comestible. The process of food consumption provided by the appliance 100 thus allows the user to consume foods such as cereal and milk without obtaining the "soggy" and undesirable taste resulting from delayed consumption following an initial mixture of the dry comestible and liquid.

Referring to FIG. 1, the appliance 100 includes a lower fluid compartment 102 which can be configured as a cylindrical container having a circular base portion 110 and a vertically-disposed cylindrical portion 108 extending upwards from the base 110. The lower fluid compartment 102 can be manually filled with a fluid 104, such as milk, to any desired level necessary to provide liquid to the user during meal consumption.

Figure 3:
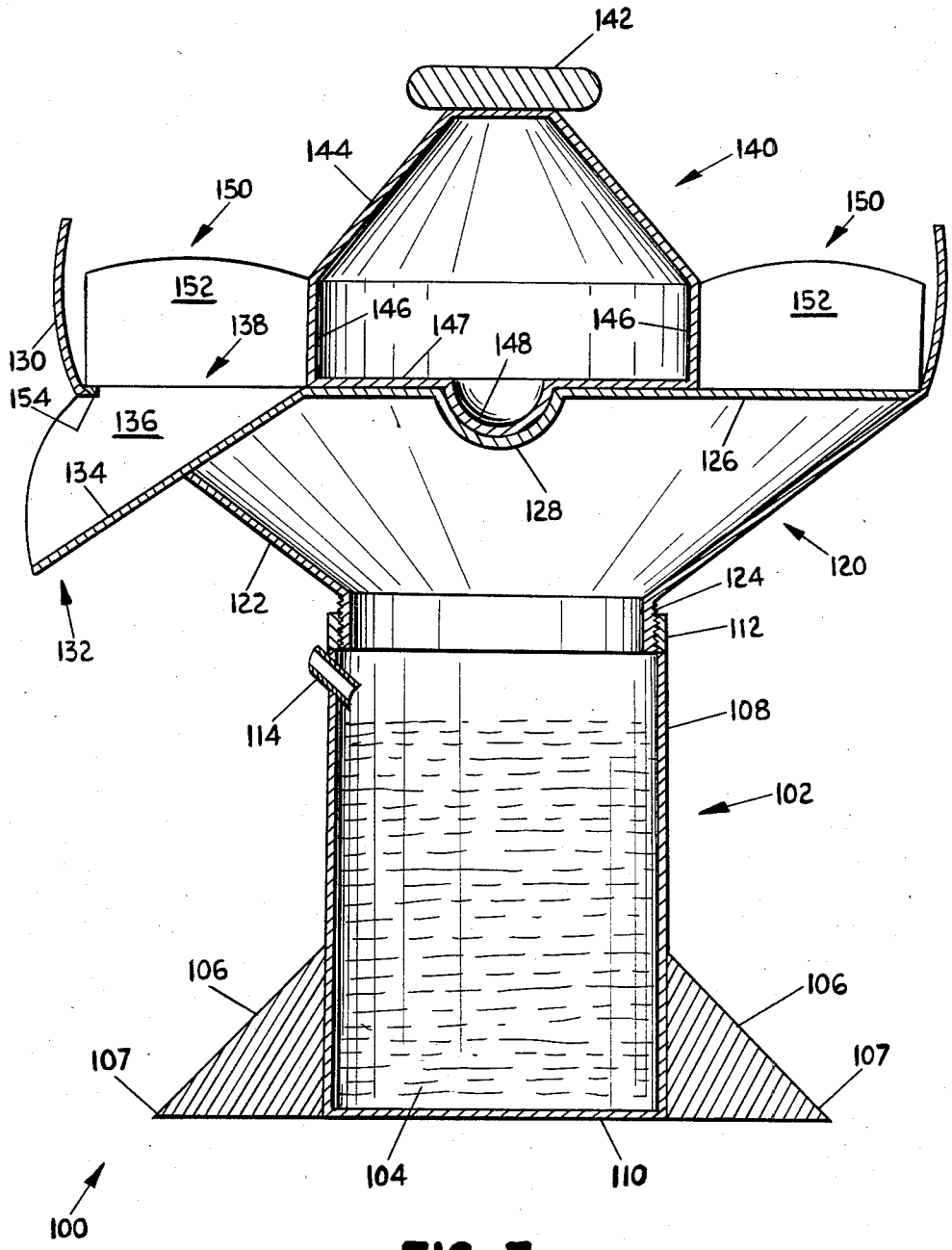
FIG. 3 is a sectional side view of the food consumption appliance depicted in FIG. 1 and taken along lines 3—3 of FIG. 2.
Figure 4:
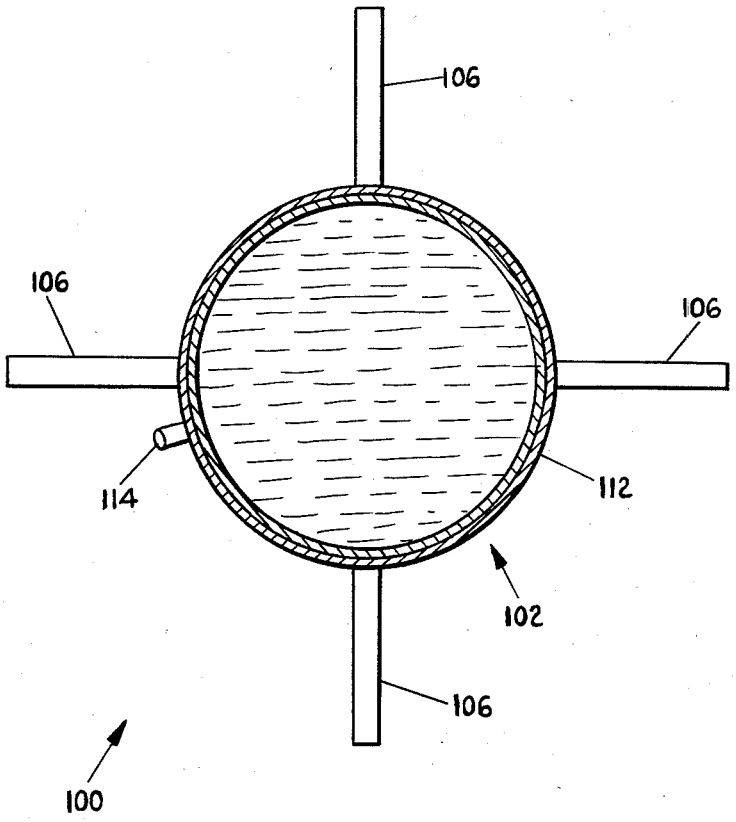
FIG. 4 is a sectional top view of the food consumption appliance depicted in FIG. 1 and taken along lines 4—4 of FIG. 1.

Mounted to the cylindrical portion 108 of lower compartment 102, and extending downward so as to be substantially flush with the plane of base portion 110, are a set of four stabilizers 106, all four stabilizers 106 being shown in a plan view in FIG. 4, and two of the stabilizers 106 being shown in a lateral sectional view in FIG. 3. The stabilizers 106 can, for example, be triangular in cross-sectional configuration, as shown in FIGS. 1 and 3, and provide a means for locating the food consumption appliance 100 in a stable manner when the appliance 100 is positioned on a table or other planar surface (not shown). The particular configuration of the stabilizers 106 is not required. For example, the stabilizers 106, having a pointed end 107 as depicted in FIG. 3, may not be particularly suitable for use by children. Accordingly, other means besides stabilizers 106 can be provided for the appliance 100 without departing from the novel concepts of the invention. For example, an annular structure having an inner diameter conforming to the diameter of the cylindrical portion 108 and having a height sufficient to stabilize the lower compartment 102 could be utilized. This annular structure could preferably have rounded portions forming an apron around the base 110 of the compartment 102 so as to avoid any pointed end hazards when the appliance 100 is adapted for use by children.

As depicted in FIGS. 1, 3 and 4, a straw hole 114 is formed within an upper portion of the lateral surface of cylindrical portion 108 of lower compartment 102. As discussed subsequently herein, the straw hole 114 is located so as to be convenient to the food consumption spout 132 and is adapted to receive various types of conventional and commercially available straws (not shown) so as to allow the user to extract the liquid 104 from the lower compartment 102. Preferably, the stabilizers 106, cylindrical portion 108, base 110 and straw hole 114 are constructed in an integral and unitary manner so as to provide substantial rigidity and structural strength to the lower fluid compartment 102.

Figure 5:
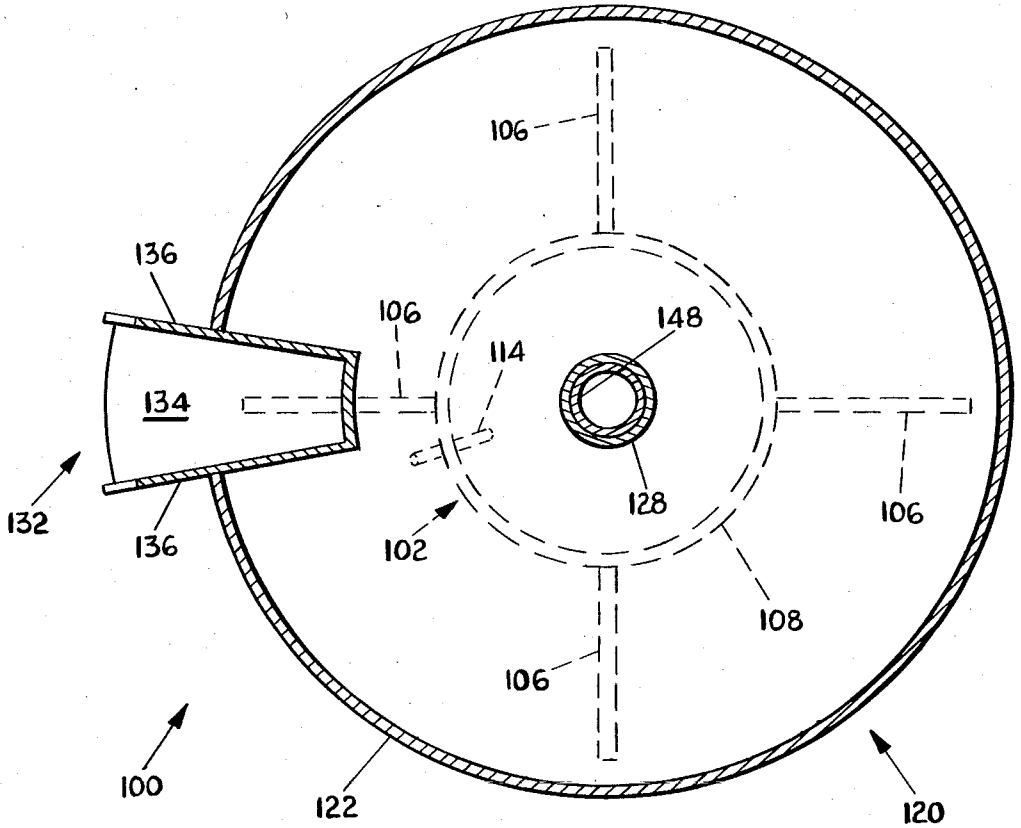
FIG. 5 is a further sectional top view of the food consumption appliance depicted in FIG. 1 and taken along lines 5—5 of FIG. 1.

Integral with or otherwise secured to the cylindrical portion 108 of lower compartment 102 is an upper internally threaded collar 112 having internal threads as depicted in FIG. 3. Threadably and removably received to the upper collar 112 is an upper compartment 120 which is generally positioned immediately above the lower fluid compartment 102. Referring to FIGS. 1, 3 and 5, the upper compartment 120 includes a frustrum-shaped portion 122, cylindrical in formation and tapering downwardly. The lower portion of the frustrum-shaped portion 122 terminates in a lower externally threaded portion 124 having external threads adapted to engage the internally positioned threads of upper collar 112 of the lower fluid compartment 102. In this manner, the upper compartment 120 can be securely fitted with and positioned above the lower fluid compartment 102. The interior of the upper compartment 120 formed within the area bounded by the outer surface of the frustrum-shaped portion 122, the horizontally-disposed platform 126 and the lower externally threaded portion 124 can preferably be hollow so as to provide a relatively lightweight structure.

Referring to FIGS. 1 and 3, the frustrum-shaped portion 120 terminates at its widest diameter portion in a horizontally-disposed upper platform 126. The planar surface 126 is substantially circular in its peripheral configuration and includes a centrally-located concave section 128 which is adapted to provide a stabilized central support for a carousel 140 subsequently described herein. Extending upwardly from the periphery of the upper platform surface 126 is an annular bowl-shaped wall 130, portions of which are shown in sectional view in FIG. 3. As will be apparent from subsequent description herein, the bowl-shaped wall 130 provides a means for retaining the dry comestibles within the subsequently described carousel 140 until consumption.

Figure 2:
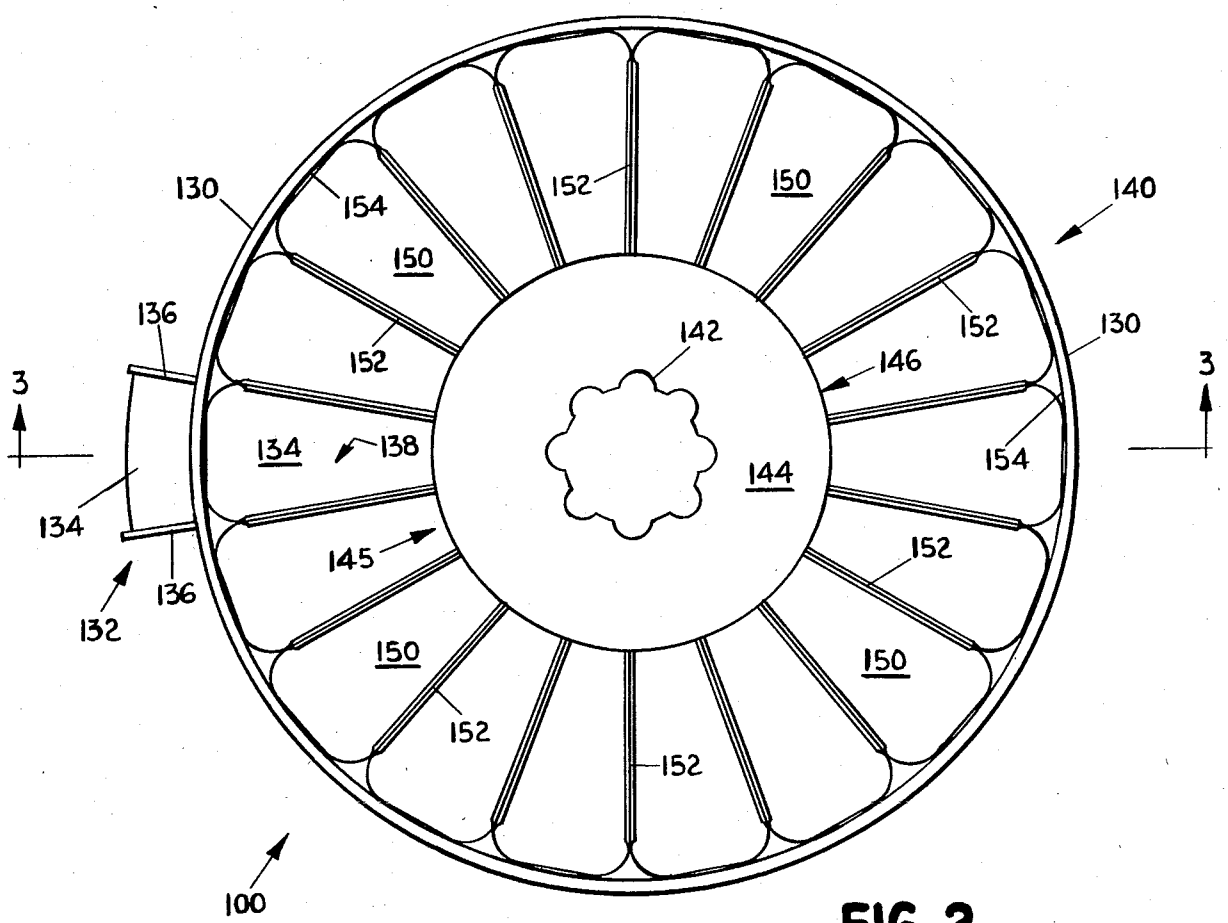
FIG. 2 is a plan view of the food consumption appliance depicted in FIG. 1.

Referring to FIGS. 1, 3 and 5, the upper compartment 120 further comprises a food consumption spout 132 projecting laterally from the frustrum-shaped portion 122 on one side thereof. The consumption spout 132 comprises a downwardly-angled ramp surface 134 which terminates at its upper end in an integral attachment to the horizontally-disposed platform 126. The spout 132 further comprises a pair of parallel side walls 136 which are secured to and extend upwardly from the ramp surface 134 so as to form a partially enclosed slideway or channel within the food consumption spout 132. The outer edges of the side walls 136 have a rounded configuration as depicted in FIGS. 1 and 3. As depicted in FIGS. 2 and 3, the horizontally-disposed platform 126 of the upper compartment 120 is open immediately above the slideway formed by walls 136 and ramp surface 134 so as to form a drop hole 138 into the consumption spout 132.

Referring to FIGS. 1, 2 and 3, the food consumption appliance 100 further comprises a circular carousel structure 140. As will be apparent from subsequent description herein, the carousel structure 140 provides a manually rotatable means of storing dry cereal and other comestibles in separate compartmentalized sections, and dispensing these comestibles through the previously described food consumption spout 132 as selectively desired by the user.

Referring again to FIGS. 1–3, the carousel structure 140 includes an upper turning knob 142 which provides a means for the user to manually rotate the carousel 140. Integral with or otherwise secured in any suitable manner to the turning knob 142 is a frustrum-shaped section 144 having its lateral surface slanting outwardly and downward from the turning knob 142. As best depicted in FIG. 3, the frustrum-shaped section 144 is integral with and interiorly open to a vertically-disposed cylindrical section 146. The sections 144 and 146 can be characterized as a central hub, 145. The cylindrical section 146 includes a lower base 147 which encloses the interior of the hub 144 and section 146. The base 147 includes a convex surface 148 which rotatably nests within the conforming structure of the previously described concave section 128 of the upper compartment 120. The nesting of convex portion 148 within the concave portion 128 provides a stabilizing means which secures the carousel structure 140 in a stable manner above the upper compartment 120, while providing manually actuable rotation of the carousel 140 relative to the upper compartment 120 and lower compartment 102 of food consumption appliance 100.

Again referring to FIGS. 1–3, the carousel structure 140 further comprises a set of radially projecting spoon section compartments 150 which circumscribe the hub 145 as depicted in FIG. 2. The spoon sections 150 are formed by section walls 152 having a lateral configuration as best depicted in FIG. 3. The section walls 152 are integral with or otherwise secured to the cylindrical surface of section 146 and extend from a lower position substantially flush with the base 147 upwardly to a height substantially flush with the lower termination level of the frustrum-shaped hub 144. Each of the section walls 152 projects radially outward from the cylindrical section 146 and terminates in an outer edge adjacent and substantially conforming to the interior surface of the wall 130. The walls 152 therefore separate and compartmentalize adjacent spoon sections 150.

To provide structural support for the spoon sections 150, an annular outer support rim 154 is secured to the outer portion of each of the walls 152. Preferably, the spoon sections 150 are of a size so that dry comestibles such as cereal received within each of the spoon sections 150 substantially conform to a desired volume of cereal to be received by the user as one "mouthful." In addition, the carousel structure 140 formed by the turning knob 142, hub 145, spoon sections 150 and outer support rim 154 are formed as a unitized integral structure during manufacture.

The operation of the food consumption appliance 100 will now be described with respect to FIGS. 1–5. Prior to initial use by the consumer, the upper compartment 120 is threadably removed from the lower fluid compartment 102. The lower compartment 102 can be placed on a preferably level surface and supportably maintained thereon by the stabilizers 106. Alternatively, the entire food consumption appliance 100 can be handheld during use.

With the upper compartment 120 removed from the lower fluid compartment 102, a liquid 104, such as milk, can be poured into the cylindrical portion 108 of the compartment 102. The amount of liquid 104 poured into compartment 102 should preferably correspond to the amount of milk or other liquid which the user will consume during the meal. When the liquid 104 is stored in container 102, a straw (not shown) or other suitable sipping means can be inserted into the straw hole 114 so as to provide a means for the user to extract the liquid 104 from compartment 102.

When the compartment 102 is filled with liquid 104, the upper compartment 120 can then be mounted to the lower fluid compartment 102 by threadably engaging the external threads of portion 124 with the internal threads of upper collar 112. The upper compartment 120 should be threadably secured to the collar 112 of lower fluid compartment 102 in a manner such that the food consumption spout 132 is conveniently adjacent the straw hole 114. The straw is then preferably positioned within the straw hole 114 after the upper compartment 120 is threadably mounted to lower fluid compartment 102. The carousel structure 140 can then be mounted above the upper compartment 120 by engaging the convex portion 148 of base 147 with the concave portion 128 of upper platform 126. It will be apparent to the reader that the materials from which the carousel 140 and upper compartment 120 are constructed should allow for relatively frictionless rotational movement of the base 147 and convex portion 148 relative to the platform 126 and concave portion 128.

With the consumption appliance 100 assembled as previously described, cereal or other desired dry comestibles can then be poured into the spoon sections 150 so that each section 150 retains an amount of cereal corresponding to a desired "mouthful" by the user. It will also be apparent to the user that sweeteners or other types of dry condiments can be added to the cereal while the cereal is stored in the spoon sections 150. It should be noted that the downward and outwardly-slanted configuration of the frustrum-shaped hub 144 assists in pouring cereal or other comestibles from a box or bag into the spoon sections 150.

Although the cereal or other comestible is poured into the spoon sections 150, one of the sections is maintained in an empty state. Specifically, when the carousel structure 140 is rotatably mounted to the upper compartment 120, one of the spoon sections 150 should be aligned with the drop hole 138. This particular spoon section 150 remains void of cereal.

With the cereal or other comestibles stored within the spoon sections 150 as described above, the user can then position his/her mouth on the food consumption spout 132 and manually manipulate the turning knob 142 so as to rotate the carousel 140. Preferably, the turning knob 142 can comprise a rim having circumscribed protuberances which provide the user with a relatively high degree of frictional contact and ease of manipulation when the carousel 140 is manually rotated. Such a turning knob 142 is depicted as shown in FIG. 2. The relative ease of rotation can be substantially important when the consumption appliance 100 is used by children.

As the carousel structure 140 is rotated, the cereal within each of the spoon sections 150 will sequentially pass over the drop hole 138, thereby dispensing the stored cereal downwardly into the food consumption spout 132. The dispensed cereal will flow through the consumption spout 132 into the user's mouth. After a mouthful of cereal from one of the spoon sections 150 is obtained by the user, the user can then cease manual rotation of the carousel 140, remove his/her mouth from the spout 132 and extract a desired amount of liquid 104 from the lower fluid compartment 102 through the straw positioned within the conveniently located straw hole 114.

When the cereal and liquid 104 has been consumed, the user can then again place his/her mouth on the spout 132, initiate rotation of the carousel 140 and obtain another mouthful of cereal from the next sequential spoon section 150 to pass over and align with the drop hole 138. Alternatively, of course, the user, if desired, can obtain two or more sequential mouthfuls of cereal before ceasing rotation of the carousel 140 and obtaining liquid refreshment. Especially for children, the structural configuration of the carousel 140 and its capability of manual rotation should enhance the enjoyment of a meal.

It should be noted that various additions and modifications can be made to the food consumption appliance 100 in accordance with the invention without departing from the novel principles of the invention. For example, as previously described, the stabilizers 106 can be modified so as to avoid the pointed ends 107 depicted in FIG. 3. Such a modified stabilizing assembly can include an annular structure having rounded surfaces and forming an apron around the lower outer surface of the cylindrical portion 108 of lower compartment 102.

A further modification to the consumption appliance 100 within the scope of the invention relates to means for automating the functional operation of the appliance 100. For example, means such as a push-button motor or comparable energizing means could be adapted for use with appliance 100 so as to automate selective rotation of carousel structure 100. In addition, a pump or similar automated extraction means could be adapted for use with appliance 100 to automatically selectively extract liquid from the fluid compartment 100.

It is also possible to secure a handle or similar device to the lower fluid compartment 102. Such a handle or other gripping device can be advantageous when the user desires to hold the food consumption appliance 100, rather than positioning the appliance 100 on a planar surface.

Furthermore, a cover can be placed over the spoon sections 150 and the carousel 140 to prevent the carousel structure 140 from becoming dislodged. In addition, the cover will eliminate spillage of cereal or other comestibles. For example, an annular cover formed of a substantially planar surface with a circular opening in the central portion thereof can be employed. The circular opening would conform to the largest diameter of the frustrum-shaped hub 145. The cover could include "snap-on" means or other suitable connecting means so as to secure the cover to the bowl-shaped wall 130. For example, the cover could have an outer rim having a downwardly depending lip portion which could be secured over the outer edge of the bowl-shaped wall 130 in a manner similar to the connection arrangement used with reusable covers on commercially available coffee containers or similar structures.

It should further be noted that the particular structural configurations described herein for the food consumption appliance 100 are not meant to be an exhaustive enumeration of the structural configurations which can be utilized in accordance with the invention. In addition, although the consumption appliance 100 has been described for use with cereals, the appliance 100 can be used with such foods and liquids as nuts, beer, soda beverages, small fruits and the like. Accordingly, it will be apparent to those skilled in a pertinent art that modifications and variations of the above-described illustrative embodiments of the invention can be effected without departing from the spirit and scope of the novel concepts of the invention.

The embodiments of the invention in which an exclusive property or privilege is claimed are defined as follows:

1. A food consumption appliance adapted for use by a human consumer on a table or similar surface for consuming a liquid and a comestible, such as cereal and the like, where said comestible is maintained in a substantially dry state separate from said liquid until actual consumption, said food consumption appliance comprising:

liquid storage means including a bottom, at least one side wall and an open top fillable by said consumer for storing said liquid separately from said comestible;

liquid extraction means located in an upper portion of said side wall of said liquid storage means and adapted to receive a straw or similar device for extracting said liquid from said liquid storage means as selectively desired by said consumer, whereby portions of said liquid are selectably extractable by said consumer from said liquid storage means;

dry comestible storage means rotatably mounted on and above said liquid storage means for holding portions of said dry comestible prior to consumption by said consumer, said dry comestible storage means proving a closure for the open top of said liquid storage means;

spout means communicating with and positioned below said dry comestible storage means, and adapted to be partially received or otherwise positioned adjacent the mouth of said consumer for providing a slideway for said portions of said dry comestible dispensed by said comestible storage means directly into said consumer's mouth;

means for dispensing selected portions of said dry comestible sequentially into said spout means upon rotation of said comestible storage means with respect to said liquid extraction means so as to sequentially dispense said portions of said dry comestible into said spout means; and said liquid extraction means is positioned adjacent said spout means so as to conveniently allow said consumer to extract portions of said liquid from said liquid storage means subsequent in time to said consumer receiving one or more of said portions of said dry comestible.

2. A food consumption appliance in accordance with claim 1 and further comprising upper compartment means removably secured at a lower section thereof to said liquid storage means, attached to said spout means, and rotatably mounting said comestible storage means.

3. A food consumption appliance in accordance with claim 2 wherein said liquid storage means comprises an internally threaded upper collar and said upper compartment means comprises an externally threaded lower section adapted to be threadably received in said upper collar.

4. A food consumption appliance in accordance with claim 2 wherein said upper compartment means further comprises:

a frustrum-shaped portion downwardly tapered and connected at a lower end thereof to said externally threaded lower section;

an upper horizontally-disposed platform connected to said frustrum-shaped portion at an upper end thereof;

a cylindrically-shaped wall extending upwardly from said horizontally-disposed platform; and a concave indentation centrally located in said platform for rotatably supporting in a stabilized manner said comestible storage means.

5. A food consumption appliance in accordance with claim 4 wherein said spout means comprises:

an angled ramp surface extending downwardly from said platform through a slot formed in an outer section of said frustrum-shaped portion; and a pair of parallel side walls extending upwardly from lateral edges of said ramp surface.

6. A food consumption appliance in accordance with claim 5 wherein said liquid storage means comprises a cylindrical portion, said liquid extraction means comprises a straw hole communicating through an upper section of said cylindrical portion and said ramp surface is adjacent said straw hole.

7. A food consumption appliance in accordance with claim 6 wherein said side walls include rounded outer edges so that said spout means can be safely partially received within the mouth of said consumer.

8. A food consumption appliance in accordance with claim 2 wherein said comestible storage means comprises compartmentalized sections for holding said portions of said dry comestible, and wherein each of said compartmentalized sections substantially corresponds in planar area to the area of said spout means, and each of said compartmentalized sections sequentially passes over said spout means in response to manual rotation of the comestible storage means so as to sequentially dispense said portions of said dry comestible into said spout means.

9. A food consumption appliance in accordance with claim 2 wherein said comestible storage means comprises:

a central hub rotatably mounted to said upper compartment means; and a series of compartmentalized sections extending radially from said central hub, wherein each of said compartmentalized sections is adapted to receive one of said portions of said dry comestible.

10. A food consumption appliance in accordance with claim 9 wherein said comestible storage means further comprises a convex portion extending downwardly from said central hub for rotatably mounting said comestible storage means to said upper compartment means.

11. A food consumption appliance in accordance with claim 10 wherein said comestible storage means further comprises:

a turning knob mounted to the upper portion of said central hub; and said compartmentalized sections are open at the respective tops and bottoms thereof, and separated by vertically-disposed side walls radially extending outward from said central hub.

12. A food consumption appliance in accordance with claim 1 and further comprising stabilizing means mounted to a lower section of said liquid storage means for stabilizing said food consumption appliance when said appliance is positioned on a planar surface.

13. A food consumption appliance in accordance with claim 1 wherein said liquid storage means comprises a horizontally-disposed base and a vertically-disposed portion extending upwardly therefrom so as to form an open-topped cup-shaped container.

14. A food consumption appliance in accordance with claim 13 wherein said liquid extraction means comprises a straw hole located in an upper section of said vertically-disposed portion and adapted to receive a straw or similar device for allowing the consumer to extract said liquid from said liquid storage means.

15. A food consumption appliance in accordance with claim 13 wherein said liquid storage means further comprises an internally threaded collar integral with an upper section of said vertically disposed portion.

16. A food consumption appliance adapted for use by a consumer for consuming a liquid and a comestible, such as cereal and the like, where said comestible is maintained in a substantially dry state separate from said liquid until actual consumption, said food consumption appliance comprising:

a liquid storage compartment adapted to be positioned on a table or similar surface or hand-held by the user;

stabilizer means mounted to said liquid storage compartment for stabilizing the food consumption appliance when positioned on said table or similar surface;

a straw hole communicating through a lateral surface of said liquid storage compartment and adapted to receive a straw or similar device to allow the user to extract portions of said liquid from said liquid storage compartment;

an upper compartment removably secured to the liquid storage compartment, and comprising a downwardly tapering frustum-shaped portion, with a horizontally-disposed upper platform integral with said frustum-shaped portion, and a concave section centrally positioned in said platform;

a food consumption spout extending at an angle dowwardly from said platform and positioned adjacent said straw hole, and having a drop hole formed at the upper end thereof;

a rotatable carousel having a central hub, a lower convex section rotatably communicating with said concave section, and a series of spoon sections open at the top and bottom ends thereof for receiving portions of said dry comestible, wherein said spoon sections project radially outward from said hub and the area of the bottom end of each of said spoon sections substantially corresponds to the area of said drop hole;

said upper compartment further comprises a cylindrically-shaped wall extending upward from said platform and conforming to the perimeter formed by the outer edges of said spoon sections;

said central hub includes a downwardly and outwardly slanted frustrum-shaped surface so as to assist in dispensing said dry comestible into said spoon sections; and said food consumption appliance further comprises a supporting rim connected to outer portions of each of said spoon sections.

* * * * *